US006399559B1

(12) United States Patent
Elms et al.

(10) Patent No.: US 6,399,559 B1
(45) Date of Patent: Jun. 4, 2002

(54) STABLE BLEACHING AGENTS CONTAINING BIS(ORGANOSILYL) PEROXIDES

(75) Inventors: Russell Allen Elms, Midland, MI (US); Franck Renauld, Chaumont Gistoux (BE); Anil K. Tomar, Midland, MI (US)

(73) Assignees: Dow Corning Corporation, Midland, MI (US); Dow Corning SA, Seneffe (BE)

( * ) Notice: Subject to any disclaimer, the term of this patent is extended or adjusted under 35 U.S.C. 154(b) by 97 days.

(21) Appl. No.: 09/609,322

(22) Filed: Jun. 30, 2000

Related U.S. Application Data

(62) Division of application No. 09/199,644, filed on Nov. 25, 1998, now Pat. No. 6,242,408.

(51) Int. Cl.[7] ..... C11D 3/395

(52) U.S. Cl. ..... 510/375; 510/309; 510/372

(58) Field of Search ..... 510/309, 375, 510/372, 276, 302, 367, 370, 371, 466

(56) References Cited

U.S. PATENT DOCUMENTS

| | | | | |
|---|---|---|---|---|
| 2,692,887 A | 10/1954 | Berry | | |
| 3,700,712 A | 10/1972 | Ostrozynski | ..... | 260/448.2 E |
| 3,843,703 A | 10/1974 | Ostrozynski | ..... | 260/448.2 E |
| 4,161,485 A | 7/1979 | Halle et al. | ..... | 260/448.2 R |

FOREIGN PATENT DOCUMENTS

| | | | | |
|---|---|---|---|---|
| DE | 19714440 | 10/1998 | ..... | C01B/15/14 |
| EP | 0812907 A1 | 12/1997 | | |
| WO | WO 9714701 | 4/1997 | | |

OTHER PUBLICATIONS

Pike et al. "Chemistry and Industry," 1957 p. 1294.
"Chemical Abstract" 1958, vol.. 54, 4471.
Hahn et al. "Organosiliciumperoxyde als Initiatoren." 1956.
Ricci et al. "Synthesis," 1986, p. 633.
Cookson et al. "Organomet. Chem.," 1975, 99, C31.
Dembech et al. Org. Synth., 74 (1997), pp. 84–90.
Jackson, W.P. "Snylett," 1990 p. 536.
Tanatar. "Russian Chem. Soc.," 1906, vol. 40, p. 376.

*Primary Examiner*—Yogendra N. Gupta
*Assistant Examiner*—John M Petruncio
(74) *Attorney, Agent, or Firm*—Timothy J. Troy

(57) ABSTRACT

This invention relates to organosilyl peroxide compounds which are stable in aqueous systems and are used for bleaching and cleaning applications. More particularly, this invention is concerned with the stability of bis(organosilyl) peroxides when formulated in aqueous and non-aqueous delivery systems. The liquid detergents containing the organosilyl peroxide compounds of this invention exhibit excellent bleaching performance and stain removal properties on fabrics at typical low wash temperatures.

16 Claims, No Drawings

STABLE BLEACHING AGENTS CONTAINING BIS(ORGANOSILYL) PEROXIDES

CROSS-REFERENCE TO RELATED APPLICATIONS

This patent application is a divisional of U.S. patent application Ser. No. 09/199,644, filed Nov. 25, 1998, which is now U.S. Pat. No. 6,242,408 B1.

FIELD OF THE INVENTION

This invention relates to organosilyl peroxide compounds which are stable in aqueous systems and are used for bleaching and cleaning applications. More particularly, this invention is concerned with the stability of bis(organosilyl) peroxides when formulated in aqueous and non-aqueous delivery systems. The liquid detergents containing the bleaching agent compositions of this invention exhibit excellent bleaching performance and stain removal properties on fabrics at typical low wash temperatures.

BACKGROUND OF THE INVENTION

Peroxygen bleaching agents, such as hydrogen peroxide, or precursors to hydrogen peroxide such as sodium perborate and sodium percarbonate, are commonly used as bleaching agents in heavy duty granular detergents for laundry application. Attempts have been made in the past to incorporate peroxy bleaching agents in aqueous and non-aqueous liquid detergents for a stable composition and there has always been a lack of stability of peroxy bleaching agent due to its high solubility in aqueous mediums and the decomposition of unstable hydrogen peroxide. Thus, there is no liquid detergent containing bleach commercially available which has an acceptable degree of chemical stability.

Heavy duty liquid detergent compositions (HDL's) commercially available at present typically comprise organic surfactants, enzymes and perfumes. These components are generally incompatible with peroxygen bleaches. Therefore, no peroxygen bleach containing liquid detergent compositions are commercially available which have long term storage stability.

The preparation of alkyl and aryl silicon peroxide and their uses in washing compositions have been disclosed. For example, in PCT Patent Publication No. WO9714701 is disclosed the preparation of alkyl and aryl silicon peroxides by the reaction of alkoxy or aryloxysilane with $H_2O_2$, more specifically tetraalkoxy and tetraaryloxy silane with $H_2O_2$ and the use of these silicon peroxides as bleaches.

In European Patent Publication No. 0812907 is disclosed the use of hydroperoxides such as organomineral hydroperoxides including $(CH_3)_3SiOOH$, $(C_6H_5)_2CH_3SiOOH$, $(C_6H_5)_3SiOOH$ and $(n\text{-}C_6H_{13})_3SiOOH$ in a bleaching composition. EP'907 also discloses a process of bleaching fabrics, starting from a liquid composition comprising a hydroperoxide, and discloses that improved fabric safety in terms of loss of tensile strength in the fabrics is obtained by using the hydroperoxides which generate free radicals of lower reactivity.

It has been surprisingly found that the stable aqueous liquid bleach containing detergents can be obtained by using bis(organosilyl)peroxide as a source of active oxygen. The bis(organosilyl)peroxide containing aqueous emulsions and solutions are stable over a wide range of pH and showed a little or no loss of peroxy content when stored for six months at 25° C.

SUMMARY OF THE INVENTION

This invention relates to a stable liquid bleaching agent composition comprising a bis(organosilyl)peroxide, at least one surfactant selected from the group consisting of at least one nonionic surfactant, at least one anionic surfactant, and a mixture of at least one nonionic surfactant and at least one anionic surfactant, and water.

This invention further relates to a stable liquid bleaching agent composition comprising a bis(organosilyl)peroxide and at least one water soluble alcohol.

It is an object of this invention to produce stable liquid bleaching agent compositions which are stable in solutions and emulsions over a wide range of pH and show a little or no loss of peroxy content when stored for long periods of time.

It is another object of this invention to produce bleaching agent compositions which are useful in laundry detergents.

It is another object of this invention to produce a bleaching agent composition which when added to a laundry detergent, provides the laundry detergent with excellent stain removal at low wash temperatures.

DETAILED DESCRIPTION OF THE INVENTION

This invention relates to a stable liquid bleaching agent composition comprising: (A) a bis(organosilyl)peroxide having its formula selected from the group consisting of (i)

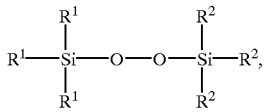

(ii)

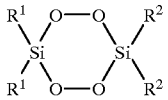

, and (iii) a mixture of (i) and (ii)

wherein each $R^1$ and each $R^2$ is independently selected from the group consisting of hydrogen, alkyl groups, cycloalkyl groups, aryl groups, alkenyl groups, polyoxyethylene groups, polyoxypropylene groups, and polyoxyethylene-polyoxypropylene groups, or $R^1$ and $R^2$ together form a silicon-containing heterocyclic ring, (B) at least one surfactant selected from the group consisting of at least one nonionic surfactant, at least one anionic surfactant, and a mixture of at least one nonionic surfactant and at least one anionic surfactant, and (C) water.

The alkyl groups of $R^1$ and $R^2$ are exemplified by methyl, ethyl, propyl, butyl, tert-butyl, hexyl, 2-ethylhexyl, n-octyl, decyl, dodecyl, and n-octadecyl, the aryl groups are exemplified by phenyl, tolyl, and xylyl, the cycloalkyl groups are exemplified by cyclopentyl and cyclohexyl, and the alkenyl groups are exemplified by vinyl, allyl, propenyl, butenyl, and hexenyl.

The polyoxyethylene groups are exemplified by groups having the formula $—R^3(OC_2H_4)_aOR^4$ wherein $R^3$ is a divalent hydrocarbon group having from 1 to 20 carbon atoms, $R^4$ is selected from the group consisting of a hydrogen atom, an alkyl group, an aryl group, and an acyl group, and a has an average value from 1 to 150.

The group $R^3$ is a divalent hydrocarbon group having from 1 to 20 carbon atoms which is exemplified by alkylene groups exemplified by methylene, ethylene, trimethylene, tetramethylene, 2-methyltrimethylene, pentamethylene, hexamethylene, 3-ethyl-hexamethylene, octamethylene, decamethylene, dodecamethylene, and octadecamethylene, and cycloalkylene radicals such as cyclohexylene, arylene radicals such as phenylene, combinations of divalent hydrocarbon radicals such as benzylene ($—C_6H_4CH_2—$), and oxygen containing groups such as $—CH_2OCH_2—$, $—CH_2CH_2CH_2OCH_2—$, $—CH_2CH_2OCH_2CH_2—$, $—COOCH_2CH_2OOC—$, $—CH_2CH_2OCH(CH_3)CH_2—$, and $—CH_2OCH_2CH_2OCH_2CH_2—$. Preferred alkylene groups have from 2 to 8 carbon atoms.

The group $R^4$ can be a hydrogen atom, an alkyl group, an aryl group, or an acyl group. The alkyl groups are exemplified by methyl, ethyl, propyl, butyl, hexyl, octyl, and decyl. The aryl groups are exemplified by phenyl, tolyl, and xylyl. The acyl group can have from 1 to 20 carbon atoms and include groups such as acetyl, propionyl, butyryl, isobutyryl, lauroyl, myristoyl, and stearoyl 3-carboxypentadecanoyl. Preferably the acyl group is a group having the formula $—OCR^5$ wherein $R^5$ denotes a monovalent hydrocarbon group. The monovalent hydrocarbon groups of $R^5$ are preferably lower alkyl groups such as methyl, ethyl, or butyl. Preferably a has a value of 1 to 36.

The polyoxypropylene groups are exemplified by groups having the formula $—R^3(OC_3H_6)_bOR^4$ wherein $R^3$ is a divalent hydrocarbon group having from 1 to 20 carbon atoms, $R^4$ is selected from the group consisting of a hydrogen atom, an alkyl group, an aryl group, and an acyl group, and b has an average value from 1 to 150. The groups $R^3$ and $R^4$ are as defined above, including preferred embodiments thereof. Preferably b has a value of 1 to 36.

The polyoxyethylene-polyoxypropylene groups are exemplified by a group having the formula $—R^3(OC_2H_4)_a(OC_3H_6)_bOR^4$ wherein $R^3$ is a divalent hydrocarbon group having from 1 to 20 carbon atoms, $R^4$ is selected from the group consisting of a hydrogen atom, an alkyl group, an aryl group, and an acyl group, and a and b have an average value from 1 to 150. The groups $R^3$ and $R^4$ are as defined above, including preferred embodiments thereof. Preferably a and b have a value of 1 to 36.

The groups $R^1$ and $R^2$ together can form a silicon-containing heterocyclic ring, in such a case, Component (A) is exemplified by bis(cyclotetramethylenesilyl)peroxide.

Each $R^1$ and $R^2$ can be the same or different, as desired. It is preferred that each $R^1$ and each $R^2$ is independently selected from the group consisting of methyl and phenyl, and it is highly preferred that each $R^1$ and $R^2$ is methyl or that each $R^1$ and $R^2$ is phenyl. It is especially preferred that Component (A) is selected from the group consisting of bis(trimethylsilyl)peroxide and bis(triphenylsilyl)peroxide.

Methods of preparing Component (A) have been described in the art, for example by Pike et al., Chemistry and Industry, Sep. 28, 1957, p. 1294, in Chemical Abstract Vol. 54, 1958, p.4471, by Hahn et al., Organosiliciumperoxyde als Initiatoren, 1956, by Berry in U.S. Pat. No. 2,692,887, by Ricci et al., Synthesis 1986, 633, by Cookson et al., Organomet. Chem. 1975, 99 C31, by Dembech, et al., Org. Synth. 74 (1997) p 84–90, by Jackson, W. P., Synlett, 1990, 536, by Tanatar, Russian Chem. Soc., 1906, 40, 376, by Wannagat, Z. Anorg. Allgem. Chem., 1963, 321, 208, by Babin, et al., Synthetic Communications, 22(19), 2849–2852 (1992), by Girsewald, Chem. Ber., 1921, 54, 492, in U.S. Pat. No. 4,161,485, and in U.S. Pat. No. 3,843,703.

Component (A), the bis(organosilyl)peroxide, is generally present in an amount from 0.5 to 90 weight percent (wt %), said wt % being based on the total weight of the stable liquid bleaching agent composition.

Component (B) is at least one surfactant selected from the group consisting of at least one nonionic surfactant, at least one anionic surfactant, and a mixture of at least one nonionic surfactant and at least one anionic surfactant. Examples of suitable nonionic surfactants include polyoxyethylene alkyl ethers, polyoxyethylene alkylphenol ethers, polyoxyethylene lauryl ethers, polyoxyethylene sorbitan monoleates, polyoxyethylene alkyl esters, polyoxyethylene sorbitan alkyl esters, polyethylene glycol, polypropylene glycol, diethylene glycol, ethoxylated trimethylnonanols, polyoxyalkylene glycol modified polysiloxane surfactants, or mixtures thereof.

Examples of suitable anionic surfactants include alkali metal alkyl sulfonates, sulfonated glyceryl esters of fatty acids such as sulfonated monoglycerides of coconut oil acids, salts of sulfonated monovalent alcohol esters such as sodium oleylisethianate, amides of amino sulfonic acids such as the sodium salt of oleyl methyl tauride, sulfonated products of fatty acids nitriles such as palmitonitrile sulfonate, sulfonated aromatic hydrocarbons such as sodium alpha-naphthalene monosulfonate, condensation products of naphthalene sulfonic acids with formaldehyde, sodium octahydroanthracene sulfonate, alkali metal alkyl sulfates such as ammonium lauryl sulfate or triethanol amine lauryl sulfate, ether sulfates having alkyl groups of 8 or more carbon atoms such as sodium lauryl ether sulfate or sodium alkyl aryl ether sulfates, alkylarylsulfonates having 1 or more alkyl groups of 8 or more carbon atoms, alkylbenzenesulfonic acids which are exemplified by hexylbenzenesulfonic acid, octylbenzenesulfonic acid, decylbenzenesulfonic acid, dodecylbenzenesulfonic acid, cetylbenzenesulfonic acid, and myristylbenzenesulfonic acid, salts of alkylbenzenesulfonic acids, sulfuric esters of polyoxyethylene alkyl ether including $CH_3(CH_2)_6CH_2O(C_2H_4O)_2SO_3H$, $CH_3(CH_2)_7CH_2O(C_2H_4O)_{3.5}SO_3H$, $CH_3(CH_2)_8CH_2O(C_2H_4O)_8SO_3H$, $CH_3(CH_2)_{19}CH_2O(C_2H_4O)_4SO_3H$, and $CH_3(CH_2)_{10}CH_2O(C_2H_4O)_6SO_3H$, sodium salts, potassium salts, amine salts of alkylnaphthylsulfonic acid, and mixtures thereof. Component (B) can also be a mixture of the nonionic surfactants and anionic surfactants described hereinabove.

Component (B), the surfactant, is generally present in an amount from 1 to 85 wt %, and preferably from 2 to 55 wt % said wt % being based on the total weight of the stable liquid bleaching agent composition.

Water (C) forms the remainder of the compositions of this invention and is generally present at a level of from 5 to 85 wt %, preferably from 10 to 65 wt %, said wt % being based on the total weight of the stable liquid bleaching agent composition.

This invention further relates to a stable liquid bleaching agent composition comprising: (A) a bis(organosilyl) peroxide having its formula selected from the group consisting of (i)

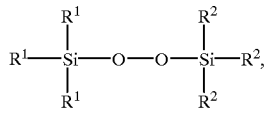

-continued (ii)

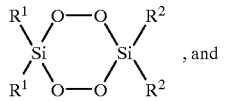

, and (iii) a mixture of (i) and (ii)

wherein each $R^1$ and $R^2$ is independently selected from the group consisting of alkyl groups, cycloalkyl groups, aryl groups, alkenyl groups, polyoxyethylene groups, polyoxypropylene groups, and polyoxyethylene-polyoxypropylene groups, or $R^1$ and $R^2$ together form a silicon-containing heterocyclic ring, and (B') at least one water soluble alcohol.

In the above formula, each $R^1$ and each $R^2$ are as described above including preferred embodiments thereof. It is preferred that each $R^1$ and $R^2$ is independently selected from the group consisting of methyl and phenyl, and it is highly preferred that each $R^1$ and $R^2$ is methyl or that each $R^1$ and $R^2$ is phenyl. It is especially preferred that Component (A') is selected from the group consisting of bis (trimethylsilyl)peroxide and bis(triphenylsilyl)peroxide.

Component (A'), the bis(organosilyl)peroxide, is generally present in an amount from 0.5 to 90 weight percent (wt %), said wt % being based on the total weight of the stable liquid bleaching agent composition.

Component (B'), is at least one water soluble alcohol, and is exemplified by monohydric and polyhydric alcohols which are liquid at ambient temperature. These alcohols are preferably selected from the group consisting of polyhydric alcohols having from 2 to 3 hydroxyl groups and from 2 to 6 carbon atoms, polymeric polyoxyalkylene alcohols having a molecular weight of from 100 to 4,000, and monoethers and polyethers thereof having at least one free hydroxyl group and an alkyl group having from 1 to 4 carbon atoms. Thus Component (B') is exemplified by ethanol, 1,3 propane diol, polyethylene glycols, polypropylene glycols, glycerols, block copolymers of ethylene oxide and propylene oxide, polyoxyethylene glycols having a molecular weight of from 100 to 400, polyoxypropylene glycols having a molecular weight of from 100 to 4,000, polyoxybutylene glycols having a molecular weight of from 100 to 4,000, and mixtures thereof.

Component (B'), the water soluble alcohol, is generally present in an amount from 5 to 95 wt %, and preferably from 10 to 65 wt % said wt % being based on the total weight of the stable liquid bleaching agent composition.

The stable liquid bleaching agent compositions of this invention are stable in solutions and emulsions over a wide range of pH and show a little or no loss of peroxy content when stored for six months at 25° C. The bleaching agent compositions of this invention which contain bis (organosilyl)peroxide are usefull in liquid laundry detergents. The silylperoxides are stable in aqueous emulsions and in solutions as evident from consistent percent active oxygen in the formulation over a long period of time. In the present invention, the silylperoxide compounds do not require a bleach activator or catalyst to promote the oxidation rate. Detergent compositions containing the liquid bleaching agent composition of this invention provide excellent stain removal at low wash temperatures.

EXAMPLES

The silylperoxide used in the examples was bis (trimethylsilyl)peroxide and this material was synthesized using the process described by Babin et. al. in the Journal of Synthetic Communication, 22 (19), pp. 2849–52 (1992) and Jackson, Synlett., p. 536, (1990) with slightly modifications to improve the yield and safe operation.

Test Method for Active Oxygen Determination

ASTM D 2180 was used to determine the active oxygen in bis(trimethylsilyl)peroxide formulated products. An accurately weighed sample of peroxide or it's formulated product ( e.g. 3.5 to 4.0 g. of a sample containing 5% active oxygen) is transferred to a Erlenmeyer flask containing 100 ml of 5 wt. % sulfuric acid solution and is immediately titrated with standard 0.1 N $KMnO_4$ solution to a faint pink color. The % active oxygen is then calculated using the following equation. The percent active oxygen in bis(trimethylsilyl) peroxide is 8.988.

$$\text{Active oxygen as O, weight } \% = \{(V-B)N \times 0.008/W\} \times 100$$

where:

V=milliliters of $KMnO_4$ solution required for titration of the sample

B=milliliters of $KMnO_4$ solution required for titration of the blank

N=normality of $KMnO_4$ solution

W=grams of sample used

Measurement of Bleaching Performance of Peroxide Bleaching Compounds

Bleaching performance is measured on cotton/polyester swatches stained with coffee, tea, or wine using a Tergotometer. The wash tests were done at different washing temperatures such as 25, 35, 45, 55 and 60° C. The detergent and peroxy bleaching agents are added to a wash solution maintained at constant temperature. The active oxygen content in the wash solution is measured and the stained swatches are washed for 15 and 60 minutes. The swatches are rinsed with cold water for 5 minutes and dried at permanent press temperature. The difference in reflectance before wash and after drying are measured and the % detergency is calculate as follows:

$$\% \text{ detergency} = \{(A-B)/(C-B)\} \times 100$$

where:

A=reflectance of washed cloth

B=reflectance of soiled cloth

C=reflectance of unsoiled cloth

Example 1

70 grams (g) of hexamethylenetetramine was charged in a three neck round bottom flask equipped with mechanical stirrer and dropping funnel. Next, 36 g of distilled water was added to the flask and mixed to make a slurry. Next, 73.6 g of a 30 wt % solution of hydrogen peroxide was added to the slurry at a slow speed while maintaining the temperature of the reaction mixture at −3 to 3° C. using IPA/dry ice mixture bath. The molar ratio of $H_2O_2$ to amine was 1.3. A clear solution was obtained after complete addition of the hydrogen peroxide. Water was evaporated at room temperature under high vacuum and the crystals of hexamethylenetetramine-$H_2O_2$ complex thus obtained were dried at 30–40° C. under vacuum.

Next, 92.8 g of the hexamethylenetetramine-$H_2O_2$ complex and 400 ml of dichloromethane solvent were mixed in a round bottom flask equipped with cold water condenser, dropping funnel and a mechanical stirrer. Next, 118.6 g of trimethylchlorosilane was added to the flask through a dropping funnel at slow speed and while maintaining the reaction mixture temperature below 0° C. After complete addition of the chlorosilane, the reaction mixture was mixed for 15 minutes at 25° C. Next, the hexamethylenetetramine-HCl precipitate is filtered and washed with dichloromethane. The low boilers are distilled under vacuum at 30–40° C. Bis(trimethylsilyl) peroxide of greater than 90% purity was obtained in good yield.

Example 2

195.7 g of bis(trimethylsilyl)urea and 90 g of finely powdered urea hydrogen peroxide complex were suspended in 600 ml of dichloromethane in a three neck round bottom flask equipped with condenser, mechanical stirrer and thermometer. The reaction mixture was heated and refluxed for 12 to 18 hrs. at 45° C. The mixture was filtered using an Aspirator and the filtrate was collected. The GC results of filtrate before distillation showed about 99.0 urea % conversion. The low boilers are distilled off under low vacuum until the GC of the pot showed less than 1.0 wt % dichloromethane. The pot content is then filtered to get >95 wt % pure product.

Example 3

Stable aqueous emulsions of bis(trimethylsilyl)peroxide were prepared by mixing 2.0 to 75.0 wt % of the bis (trimethylsilyl)peroxide in water containing nonionic surfactants. For example, an emulsion was prepared by mixing 3.6 g of octylphenoxypolyethoxyethanol and 3 g of sorbitan monolaurate in 58.4 g of water for 10 minutes. Next, 35 g of bis(trimethylsilyl)peroxide was added to the above solution at a slow speed and agitated at high speed using a sonic dismembrator. An average particle size of 0.2 to 0.4 micron was obtained and the emulsion was quite stable as no phase separation was observed after 3 months. The stability of peroxide in the emulsion was checked by measuring percent active oxygen at different time intervals. The stability results are shown in Table 1 below. The bis(trimethylsilyl)peroxide was considerably stable for at least 3 months.

Example 4

Stable non-aqueous solutions of bis(trimethylsilyl) peroxide were prepared by mixing 2–60 wt % silylperoxide in a mixture of polypropylene glycol and ethylene oxide-propylene oxide block copolymer. The peroxide solutions thus prepared were stable and dispersed quickly and homogeneously when added to the aqueous systems. For example, 6.53 g of bis(trimethylsilyl) peroxide was added to a mixture of 9 g of polypropylene glycol (P-425 from The Dow Chemical Company, Midland, Mich.) and 0.8 g of an ethylene oxide-propylene oxide block copolymer (Pluronic® P103 from BASF Corporation, Hackettstown, N.J.). The solution was slightly hazy and showed considerable stability of peroxide over the time as measured % active oxygen remained constant. The stability results are shown in Table 1 below.

Example 5

The stability of silylperoxide in liquid detergents was determined by adding 1.0 to 50.0 wt % bis(trimethylsilyl) peroxide to liquid detergents. For example, a typical liquid detergent composition containing 43.5 wt % of a linear alkylaryl sodium sulfonate (Witconate® 45L from Witco Corporation, New York, N.Y.), 15.7 wt % of an alkyl polyglycoside (Glucopon® 600 from Henkel Corporation, Ambler, Pa.), 1 wt % of a fatty acid, 7.0 wt % of a glycol, 8.3 wt % of sodium citrate, and 22 wt % of water, when formulated with 1–50 wt % of bis(trimethylsilyl)peroxide as a bleaching agent showed remarkable stability for more than two months. The stability results are shown in Table 1 below. The bis(trimethylsilyl)peroxide containing liquid detergents were also used in wash test to evaluate their stain removing performance on soiled fabrics. The results of bleach tests are summarized in Tables 2 and 3.

Example 6

The stability of bis(trimethylsilyl)peroxide in a typical commercial liquid detergent without bleach, obtained off the shelf, was checked at different concentrations of bis (trimethylsilyl)peroxide. The detergent formulation was stable for more than two months and only a slight loss of active oxygen was observed. The bis(trimethylsilyl)peroxide content in the detergent formulation ranged from 1 to 50 wt %. The stability results are shown in Table 1 below. The bis(trimethylsilyl)peroxide containing liquid detergents were also used in wash test to evaluate their stain removing performance on soiled fabrics. The results of bleach tests are summarized in Tables 2 and 3.

TABLE 1

Stability measured in terms of percent active oxygen versus time

| Bleaching Compound | Theoretical % AO | Time, days | Experimental % AO |
|---|---|---|---|
| Example 3 | 3.146 | 70 | 2.898 |
| | | 85 | 3.019 |
| | | 100 | 2.840 |
| Example 4 | 3.595 | 85 | 2.127 |
| Example 5 | 0.449 | 10 | 0.4408 |
| | | 80 | 0.3163 |
| Example 6 | 0.449 | 1 | 0.4862 |
| | | 7 | 0.3858 |
| | | 15 | 0.3951 |

TABLE 2

Bleaching performance of different bleach systems on Tea stain

| Exp. # | Wt. of detergent g/L | Wt. of Ex. (3A) g/L | Wt. of SPC/TAED g/L | pH of solution | Active oxygen in wash, g/L | Reflectance value L value | % Detergency |
|---|---|---|---|---|---|---|---|
| 1 | — | — | — | — | — | 67.22 (B) | — |
| 2 | — | — | — | — | — | 79.86 (C) | — |
| 3 | 0.8165 | — | — | 9–10 | 0.0 | 71.81 (A) | 36.31 |
| 4 | 0.8159 | — | 0.0635/ | 9–10 | 0.0067 | 73.74 (A) | 51.58 |

TABLE 2-continued

Bleaching performance of different bleach systems on Tea stain

| Exp. # | Wt. of detergent g/L | Wt. of Ex. (3A) g/L | Wt. of SPC/TAED g/L | pH of solution | Active oxygen in wash, g/L | Reflectance value L value | % Detergency |
|---|---|---|---|---|---|---|---|
| 6 | 0.8170 | — | 0.0657 0.1523/ 0.0658 | 9–10 | 0.0173 | 75.43 (A) | 64.95 |
| 7 | 0.8171 | 0.3091 | — | 9–10 | 0.0107 | 72.77 (A) | 43.90 |
| 9 | 0.8158 | 0.6961 | — | 10–11 | 0.0239 | 74.86 (A) | 60.44 |

TABLE 3

Bleaching performance of peroxide bleaching agent on Coffee stain

| Example | Wash Temperature, ° C. | Bleach in wash liquid g./L | % Detergency |
|---|---|---|---|
| Ex. 5 | 25 | 0.073 | 60.9 |
| Ex. 5 | 55 | 0.073 | 69.6 |
| Percarbonate/TAED | 25 | 0.212/0.014 | 55.6 |
| Percarbonate/TAED | 55 | 0.212/0.014 | 68.8 |

That which is claimed is:

1. A stable liquid bleaching agent composition comprising:

(A') a bis(organosilyl)peroxide having its formula selected from the group consisting of (i)

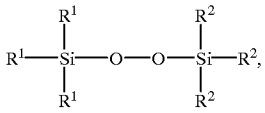

(ii)

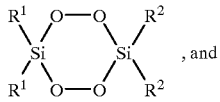

, and (iii) a mixture of (i) and (ii)

wherein each $R^1$ and $R^2$ is independently selected from the group consisting of alkyl groups, cycloalkyl groups, aryl groups, alkenyl groups, polyoxyethylene groups, polyoxypropylene groups, and polyoxyethylene-polyoxypropylene groups, or $R^1$ and $R^2$ together form a silicon-containing heterocyclic ring; and (B') at least one water soluble alcohol.

2. A composition according to claim 1, wherein the alkyl groups are selected from the group consisting of methyl, ethyl, propyl, butyl, tert-butyl, hexyl, 2-ethylhexyl, n-octyl, decyl, dodecyl, and n-octadecyl, the aryl group is phenyl, the cycloalkyl groups are selected from the group consisting of cyclopentyl and cyclohexyl, and the alkenyl groups are selected from the group consisting of vinyl, allyl, propenyl, butenyl, and hexenyl.

3. A composition according to claim 1, wherein each $R^1$ and $R^2$ is independently selected from the group consisting of methyl and phenyl.

4. A composition according to claim 1, wherein each $R^1$ and $R^2$ is methyl.

5. A composition according to claim 1, wherein each $R^1$ and $R^2$ is phenyl.

6. A composition according to claim 1, wherein the polyoxyethylene groups are groups having the formula $—R^3(OC_2H_4)_aOR^4$ and the polyoxypropylene groups are groups having the formula $—R^3(OC_3H_6)_bOR^4$ wherein $R^3$ is a divalent hydrocarbon group having from 1 to 20 carbon atoms, $R^4$ is selected from the group consisting of a hydrogen atom, an alkyl group, an aryl group, and an acyl group, and a and b have an average value from 1 to 150.

7. A composition according to claim 1, wherein the polyoxyethylene-polyoxypropylene groups are groups having the formula $—R^3(OC_2H_4)_a(OC_3H_6)_bOR^4$ wherein $R^3$ is a divalent hydrocarbon group having from 1 to 20 carbon atoms, $R^4$ is selected from the group consisting of a hydrogen atom, an alkyl group, an aryl group, and an acyl group, and a and b have an average value from 1 to 150.

8. A composition according to claim 1, wherein (A') is selected from the group consisting of bis(trimethylsilyl) peroxide and bis(triphenylsilyl)peroxide.

9. A composition according to claim 1, wherein (B') is selected from the group consisting of monohydric alcohols which are liquid at ambient temperature and polyhydric alcohols which are liquid at ambient temperature.

10. A composition according to claim 8, wherein (B') is selected from the group consisting of monohydric alcohols which are liquid at ambient temperature and polyhydric alcohols which are liquid at ambient temperature.

11. A composition according to claim 1, wherein (B') is selected from the group consisting of polyhydric alcohols having from 2 to 3 hydroxyl groups and from 2 to 6 carbon atoms, polymeric polyoxyalkylene alcohols having a molecular weight of from 100 to 4,000, and monoethers and polyethers thereof having at least one free hydroxyl group and an alkyl group having from 1 to 4 carbon atoms.

12. A composition according to claim 8, wherein (B') is selected from the group consisting of polyhydric alcohols having from 2 to 3 hydroxyl groups and from 2 to 6 carbon atoms, polymeric polyoxyalkylene alcohols having a molecular weight of from 100 to 4,000, and monoethers and polyethers thereof having at least one free hydroxyl group and an alkyl group having from 1 to 4 carbon atoms.

13. A composition according to claim 1, wherein (B') is selected from the group consisting of ethanol, 1,3 propane diol, polyethylene glycols, polypropylene glycols, glycerols, block copolymers of ethylene oxide and propylene oxide, polyoxyethylene glycols having a molecular weight of from 100 to 400, polyoxypropylene glycols having a molecular weight of from 100 to 4,000, polyoxybutylene glycols having a molecular weight of from 100 to 4,000, and mixtures thereof.

14. A composition according to claim 4, wherein (B') is selected from the group consisting of ethanol, 1,3 propane diol, polyethylene glycols, polypropylene glycols, glycerols, block copolymers of ethylene oxide and propylene oxide, polyoxyethylene glycols having a molecular weight of from 100 to 400, polyoxypropylene glycols having a molecular weight of from 100 to 4,000, polyoxybutylene glycols having a molecular weight of from 100 to 4,000, and mixtures thereof.

15. A composition according to claim 5, wherein (B') is selected from the group consisting of ethanol, 1,3 propane diol, polyethylene glycols, polypropylene glycols, glycerols, block copolymers of ethylene oxide and propylene oxide, polyoxyethylene glycols having a molecular weight of form 100 to 400, polyoxypropylene glycols having a molecular weight of from 100 to 4,000, polyoxybutylene glycols having a molecular weight of from 100 to 4,000, and mixtures thereof.

16. A composition according to claim 8, wherein (B') is selected from the group consisting of ethanol, 1,3 propane diol, polyethylene glycols, polypropylene glycols, glycerols, block copolymers of ethylene oxide and propylene oxide, polyoxyethylene glycols having a molecular weight of from 100 to 400, polyoxypropylene glycols having a molecular weight of from 100 to 4,000, polyoxybutylene glycols having a molecular weight of from 100 to 4,000, and mixtures thereof.

* * * * *